US009162250B2

(12) United States Patent
Abe et al.

(10) Patent No.: US 9,162,250 B2
(45) Date of Patent: Oct. 20, 2015

(54) METHOD FOR FORMING COATING FILM AND METHOD FOR PRODUCING FIXING MEMBER

(71) Applicant: CANON KABUSHIKI KAISHA, Tokyo (JP)

(72) Inventors: Katsuya Abe, Tokyo (JP); Yasuhiro Miyahara, Tokyo (JP); Yuji Hasegawa, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/515,666

(22) Filed: Oct. 16, 2014

(65) Prior Publication Data

US 2015/0118400 A1 Apr. 30, 2015

(30) Foreign Application Priority Data

Oct. 28, 2013 (JP) ..... 2013-223459

(51) Int. Cl.

| | |
|---|---|
| ***B05D 1/02*** | (2006.01) |
| ***G03G 15/20*** | (2006.01) |
| ***B05D 1/00*** | (2006.01) |
| ***B05D 1/26*** | (2006.01) |
| ***B05D 1/36*** | (2006.01) |
| ***B05D 1/40*** | (2006.01) |
| ***B05D 7/00*** | (2006.01) |
| ***G03G 15/00*** | (2006.01) |

(52) U.S. Cl.

CPC *B05D 1/002* (2013.01); *B05D 1/02* (2013.01); *B05D 1/26* (2013.01); *B05D 1/36* (2013.01); *B05D 1/40* (2013.01); *B05D 7/52* (2013.01); *G03G 15/00* (2013.01); *G03G 15/20* (2013.01); *G03G 15/2053* (2013.01); *G03G 15/2057* (2013.01); *B05D 2254/02* (2013.01); *B05D 2518/10* (2013.01); *G03G 15/206* (2013.01); *G03G 2215/00413* (2013.01)

(58) Field of Classification Search

USPC ..... 427/407.1

See application file for complete search history.

(56) References Cited

U.S. PATENT DOCUMENTS

| | | | | |
|---|---|---|---|---|
| 5,112,656 | A * | 5/1992 | Nakamura et al. | 430/133 |
| 2001/0036539 | A1* | 11/2001 | Finn et al. | 428/195 |
| 2014/0116599 | A1 | 5/2014 | Miyahara et al. | |
| 2014/0119789 | A1 | 5/2014 | Miyahara et al. | |
| 2014/0120352 | A1 | 5/2014 | Miyahara et al. | |
| 2014/0133892 | A1 | 5/2014 | Miura et al. | |

FOREIGN PATENT DOCUMENTS

JP 2002-370065 A * 12/2002

OTHER PUBLICATIONS

Hideki Yamamoto, "SP Value (solubility parameter) Fundamentals and Application," Seminar Text, pp. 31-38 (2006).

* cited by examiner

*Primary Examiner* — William Phillip Fletcher, III

(74) *Attorney, Agent, or Firm* — Fitzpatrick, Cella, Harper & Scinto

(57) ABSTRACT

The method for forming a coating film includes: supplying a first liquid from a nozzle to a cylindrical substrate to thereby form the coating film of the first liquid, wherein the method includes, pressing a member including a second liquid, to form a liquid film of the second liquid on the peripheral surface, and forming the coating film of the first liquid includes: supplying the first liquid onto the liquid film of the second liquid formed on the peripheral surface of the substrate to form a bead of the first liquid between the liquid-supplying unit and the liquid film of the second liquid, and extending the bead in a circumferential direction of the substrate.

8 Claims, 4 Drawing Sheets

METHOD FOR FORMING COATING FILM AND METHOD FOR PRODUCING FIXING MEMBER

BACKGROUND OF THE INVENTION

1. Field of the Invention

The present invention relates to a method for forming a coating film of a coating liquid on the peripheral surface of a cylinder/column-shaped substrate for use in charging, development, transfer, fixing, pressurizing or the like in an electrophotographic apparatus such as a copier or a printer, and a method for producing an electrophotographic fixing member.

2. Description of the Related Art

In an electrophotographic apparatus such as a copier or a printer, a member such as a cylinder/column-shaped belt or roller is used in various processes such as charging, development, transfer, fixing and pressurizing. In such a member, a functional film for exhibiting a required function is formed on a substrate depending on the application of the member. In the present specification, a cylinder-shaped substrate or a column-shaped substrate is also simply referred to as "substrate" in some cases.

Such a functional film can be formed by forming a coating film of a coating material for forming the functional film on the peripheral surface of the substrate, and drying or if necessary curing the coating film. Then, as a method for forming the coating film on the peripheral surface of the substrate, a spiral method is known (see Japanese Patent Application Laid-Open No. 2002-370065).

The spiral method is a method in which, while allowing a substrate to relatively rotate against a coating liquid-supplying unit and also allowing the coating liquid-supplying unit and the substrate to relatively move in the direction along with the rotation axis of the substrate, a coating liquid is supplied from the coating liquid-supplying unit to form a coating film on the peripheral surface of the substrate.

The spiral method can shorten the time required for coating with the coating material, and achieve the high use efficiency of the coating liquid. Therefore, a reduction in production cost can be achieved.

According to studies by the present inventors, however, the coating film formed by using the spiral method may have spiral unevenness in thickness due to the rotation period of the substrate.

The functional film of the member for use in the electrophotographic apparatus, if having an uneven thickness, may have an influence on the quality of an electrophotographic image. Therefore, the coating film formed on the substrate is required to be highly uniform in thickness.

In particular, a fixing member having a layer formed by curing an addition curing type silicone rubber composition (hereinafter, also referred to as "cured silicone rubber layer") is often used in a thermal fixing apparatus of the electrophotographic apparatus. In such a fixing member, a primer layer is formed on the peripheral surface of the substrate before formation of the cured silicone rubber layer, in order to allow the substrate and the cured silicone rubber layer to tightly adhere to each other.

Here, the primer layer may include a reactive component with an unsaturated aliphatic group (vinyl group) included in the cured silicone rubber layer to be formed thereon. In such a case, the reactive component may be transferred from the primer layer to the cured silicone rubber layer, and the reactive component and the unsaturated aliphatic group may react with each other in the cured silicone rubber layer, resulting in an increase in hardness of the cured silicone rubber layer. If the primer layer here has partial unevenness in thickness, the amount of the reactive component transferred to the cured silicone rubber layer is partially different, resulting in causing partial unevenness in hardness of the cured silicone rubber layer. Such partial unevenness in hardness of the cured silicone rubber layer can cause unevenness in melting of a toner in thermal fixing of an electrophotographic image, thereby causing unevenness in gloss in the electrophotographic image.

Therefore, the present inventors have recognized that if a coating film of a raw material for primer layer formation is formed on the substrate by using the spiral method that is advantageous in terms of costs, a new technique is required to be developed in order to cause no spiral unevenness in thickness on the coating film.

Then, the present invention is directed to providing a method for forming a coating film, which can more suppress the occurrence of unevenness in thickness of a coating film in formation of the coating film on the peripheral surface of a substrate.

Further, the present invention is directed to providing a method for producing an electrophotographic fixing member, which contributes to formation of a high-quality electrophotographic image.

SUMMARY OF THE INVENTION

According to one aspect of the present invention, there is provided a method for forming a coating film on a peripheral surface of a cylindrical or columnar substrate, comprising:

a first liquid coating film forming step comprising:

supplying a first liquid from a nozzle to the peripheral surface of the substrate that relatively rotates against the nozzle, while relatively moving the nozzle and the substrate in an axial direction of the substrate, and forming a first liquid coating film on the peripheral surface of the substrate, wherein:

the method comprises a step of forming a liquid film of a second liquid on the peripheral surface of the substrate, prior to supplying the first liquid to the peripheral surface of the substrate, by pressing a member comprising a second liquid, on the peripheral surface of the substrate, while relatively rotating the member and the substrate, and relatively moving the member and the substrate in an axial direction of the substrate, and forming a liquid film of the second liquid on the peripheral surface of the substrate, the second liquid being the same as the first liquid or having a high affinity with the first liquid, wherein:

in the first liquid coating film forming step, the first liquid is supplied onto the liquid film of the second liquid before drying the liquid film of the second liquid, and wherein:

the first liquid coating film forming step further comprises the steps of:

forming a bead of the first liquid between the nozzle and the liquid film of the second liquid, and extending the bead in a circumferential direction of the substrate.

According to another aspect of the present invention, there is provided a method for producing a fixing member having a cylindrical or columnar substrate and a cured silicone rubber layer on the substrate, comprising:

(1) forming a primer layer on a peripheral surface of the substrate, (2) forming a layer of an addition curing type silicone rubber composition on a surface of the primer layer, and (3) curing the layer of the addition curing type silicone rubber composition to form the cured silicone rubber layer, wherein the step (1) comprises the steps of:

(i) forming a coating film of a first liquid by applying the first liquid from a nozzle to a peripheral surface of the substrate, while relatively rotating the substrate against the nozzle and also relatively moving the nozzle and the substrate in a direction along with a rotational axis of the substrate, and (ii) forming a liquid film of a second liquid on the peripheral surface of the substrate, prior to forming the coating film of the first liquid, by pressing a member impregnated with the second liquid on the peripheral surface of the substrate, wherein:

in the step (i), the first liquid is supplied onto the liquid film of the second liquid on the peripheral surface of the substrate before drying the liquid film of the second liquid, wherein:

the step (i) further comprises the steps of:

forming a bead of the first liquid between the nozzle and the liquid film of the second liquid, and extending the bead in a circumferential direction of the substrate, and wherein:

the second liquid is the same as the first liquid or a liquid having a difference in solubility parameter from the first liquid of 6.0 or less, and any one or both of the first liquid and the second liquid comprise a raw material of the primer.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

(Method for Forming a Coating Film)

(1) Summary

FIGS. 1A to 1D are illustration views of a method for forming a coating film on the peripheral surface of a cylindrical substrate 1 (hereinafter, simply also referred to as "substrate"), according to the present invention. The series of the flow of the method for forming a coating film is as follows. The method for forming a coating film according to the present invention includes supplying a coating liquid from a nozzle (coating liquid-supplying unit) 3 to a substrate 1, while allowing the substrate 1 to relatively rotate against the nozzle 3 and allowing the nozzle 3 and the substrate 1 to relatively move in the direction along with the rotation axis of the substrate (arrow V in FIG. 1A), to form a coating film of a first liquid on the peripheral surface of the substrate.

Figure 1A:
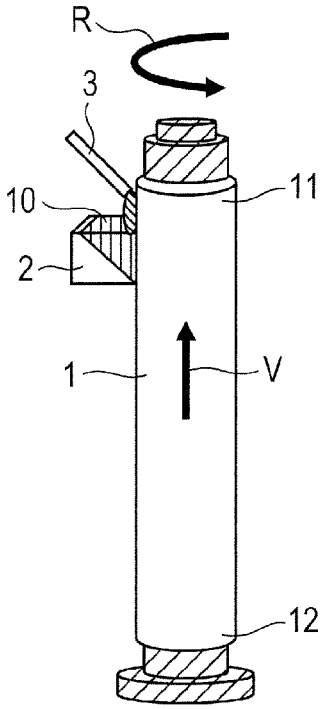
FIGS. 1A, 1B, 1C, and 1D are schematic views for illustrating one example of a method for forming a coating film according to the present invention.
Figure 1B:
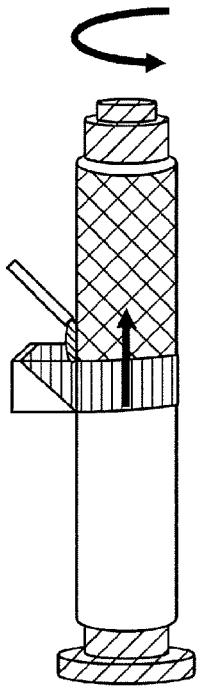
Figure 1C:
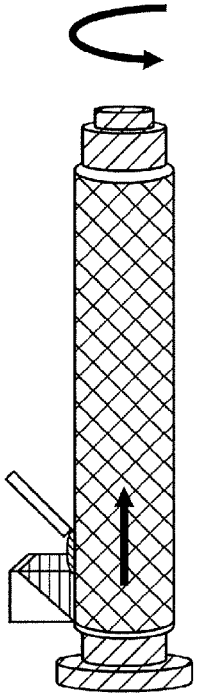
Figure 1D:
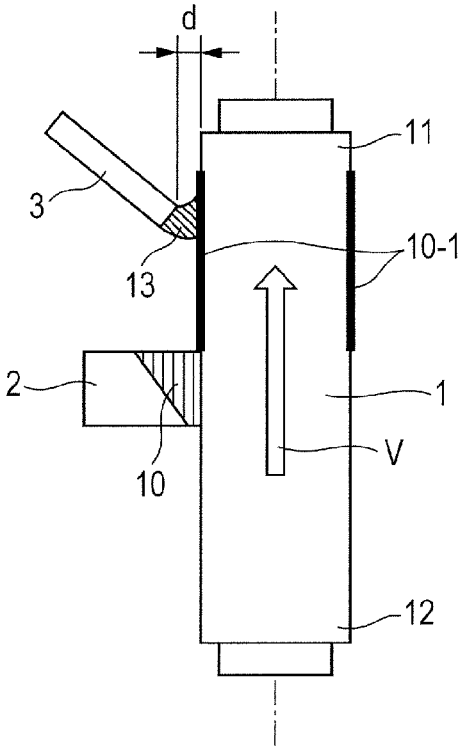

Then, in the present invention, as illustrated in FIG. 1D, before the first liquid is supplied from the nozzle 3 to the substrate 1, a member (hereinafter, "impregnation material") 2 that contains a liquid that is the same as the first liquid or that is a liquid having a high affinity with the first liquid (hereinafter, "second liquid") 10 is brought into contact with the surface of the substrate to form a liquid film 10-1 of the second liquid on the peripheral surface of the substrate.

Then, before the liquid film 10-1 of the second liquid is dried, the first liquid is supplied onto the liquid film of the second liquid from the nozzle 3 that is disposed in a predetermined distance d away from the liquid film 10-1 of the second liquid formed on the peripheral surface of the substrate 1, to form a bead (liquid drop) 13 of the first liquid between the nozzle 3 and the liquid film 10-1 of the second liquid.

Then, the bead of the first liquid formed between the nozzle 3 and the liquid film 10-1 of the second liquid is applied and extended by the rotation of the substrate 1 against the nozzle 3 (the direction of arrow R in FIG. 1A) and the relative movement of the nozzle 3 and the substrate in the direction along with the rotation axis of the substrate 1 (arrow V in FIG. 1A) in the circumferential direction of the substrate 1 and the direction along with the rotation axis of the substrate 1, to form a coating film of the first liquid on the peripheral surface of the substrate 1 (see FIG. 1B, 1C).

In the method for forming a coating film according to the present invention illustrated in FIGS. 1A to 1D, the substrate 1 has an endless belt shape, and is carried on the outer peripheral surface of a core and rotatably supported in the direction of arrow R with the center axis of the core as the rotational center.

In addition, the nozzle 3 and the substrate 1 can relatively move in the direction along with the rotation axis of the substrate 1, namely, the direction of arrow V in FIG. 1A, by a movement mechanism (not illustrated).

Then, while the substrate 1 is allowed to rotate in the direction of arrow R and to move in the direction of arrow V against the nozzle 3, the second liquid 10 is supplied by a coating liquid-supplying unit (not illustrated) and an impregnation material 2 usually filled with a coating liquid is brought into contact with the surface of the substrate 1 to thereby form a liquid film of the second liquid from the impregnation material 2 on the surface of the substrate 1 in a spiral manner. Here, dust and dirt present on the surface of the substrate 1 are also removed.

In FIG. 1A, reference numeral 11 denotes the application upstream of the substrate 1, and reference numeral 12 denotes the application downstream thereof.

The rotation speed R [rpm] of the substrate 1, the movement velocity V [mm/min] of the substrate 1, and the length L [mm] of the impregnation material 2 in the direction of the rotation axis of the substrate 1 can satisfy a relationship of the following Expression (1).

Expression (1)

$$L-(V/R)\geq 0 \qquad \text{Expression (1)}$$

V/R denotes the movement distance towards U side during one rotation of the substrate, and L−(V/R) denotes the length to which a coating liquid is dually applied by the impregnation material 2. If L−(V/R) is less than 0, a coating liquid cannot be possibly applied to a desired application region in a step of applying the second liquid (also referred to as second liquid application step).

If L−(V/R) is too large, a region to which the coating liquid is dually applied is increased and the use efficiency is deteriorated, and thus L−(V/R) can be 10 (mm) or less.

In a step of forming the coating film of the first liquid (also referred to as the coating film formation step of the first liquid), while the substrate 1 itself is allowed to rotate and move, the coating liquid (first liquid) is supplied from the nozzle 3 to the liquid film of the second liquid while a bead 13 is formed. In order to form a uniform coating film in the application step, it is important to form the bead 13. The bead refers to a liquid drop that is formed between a discharge port of the nozzle 3 and the surface of the liquid film of the second liquid. The rotation and movement of the substrate 1 acts to impress a shear force on the bead formed, apply and extend the bead in the circumferential direction of the substrate 1, and to uniformly level the surface of the liquid film. Thus, a coating film having a uniform thickness can be formed.

As in FIG. 1A→FIG. 1B→FIG. 1C, the substrate 1 is allowed to move at a movement velocity V while being allowed to rotate at a rotation speed R, and thus a liquid film of the second liquid and a coating film of the first liquid are formed on the peripheral surface of the substrate from an end portion 11 to an end portion 12.

In order to form the bead 13 of the first liquid between the nozzle 3 and the liquid film 10-1 of the second liquid, the affinity of the first liquid with the second liquid is first required to be high. The affinity is described later.

In addition, in order to stably form the bead 13, the distance d from the discharge port of the nozzle 3 to the surface of the liquid film 10-1 of the second liquid in FIG. 1D is 0 to 10 mm, in particular, preferably more than 0 mm and 10 mm or less. When the substrate is allowed to move in the axis direction, the distance d can be consistently kept constant.

In the present invention, the first liquid is required to be supplied to the liquid film of the second liquid in the step of applying the first liquid, before the liquid film 10-1 of the second liquid formed on the surface of the substrate 1 is dried.

If the liquid film 10-1 of the second liquid is dried, it is difficult to stably form the bead 13, and the thickness of the coating film of the first liquid may be non-uniform. The drying of the liquid film of the second liquid here means that when the liquid film 10-1 of the second liquid is touched by fingers, the second liquid does not adhere to fingers, namely, is set to touch.

The relative distance p from the upper end of the impregnation material 2 to the discharge port of the nozzle in the axis direction, illustrated in FIG. 1D, can be about 5 to 20 mm. When the distance p is small, the first liquid supplied from the discharge port of the nozzle 3 may be absorbed by the impregnation material 2 before the bead 13 is stably formed on the liquid film of the second liquid on the substrate 1.

When the distance p is large, the liquid film of the second liquid is dried and it is difficult to uniformly apply the first liquid.

In FIGS. 1A to 1D, the first liquid is supplied to the liquid film of the second liquid, then flows downwards from the peripheral surface of the substrate 1, and is absorbed by the impregnation material 2 including the second liquid. Therefore, when the first liquid is the same as the second liquid, a liquid can be normally included in the impregnation material 2 in coating film formation. In order to here stabilize a coating film formed, the amount of the first liquid supplied from the nozzle 3 to the substrate 1 is required to be sufficient so that a coating film can be formed on the peripheral surface of the substrate 1 and a liquid can also be stably included in the impregnation material 2.

Figure 2:
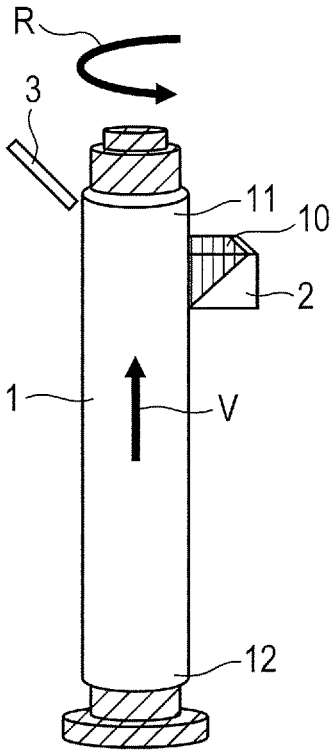
FIG. 2 is a schematic view for illustrating one example of the method for forming a coating film according to the present invention.

When the first liquid is different from the second liquid, the impregnation material 2 can be placed at a position different from the position of the nozzle 3 in the circumferential direction of the substrate 1 in order to avoid the impregnation material 2 from including the first liquid, in the configuration in FIGS. 1A to 1D. Specifically, for example, as illustrated in FIG. 2, the position at which the impregnation material 2 is in contact with the substrate 1 can be set opposite to the position of the nozzle 3, namely, at a position shifted by 180° to the position of the nozzle 3 in the circumferential direction of the substrate 1.

Herein, in order to stably form the liquid film of the second liquid, the second liquid can be constantly supplied to the impregnation material 2 by using a liquid-supplying unit (not illustrated), for example, a tube.

(2) Substrate

The present invention can be applied to a method for forming a coating film of a coating liquid on the peripheral surface of a cylinder/column-shaped substrate for use in charging, development, transfer, fixing, pressurizing or the like used in an electrophotographic apparatus such as a copier or a printer.

Figures 3A, 3B, 3C, 3D, 3E, 3F, 3G:
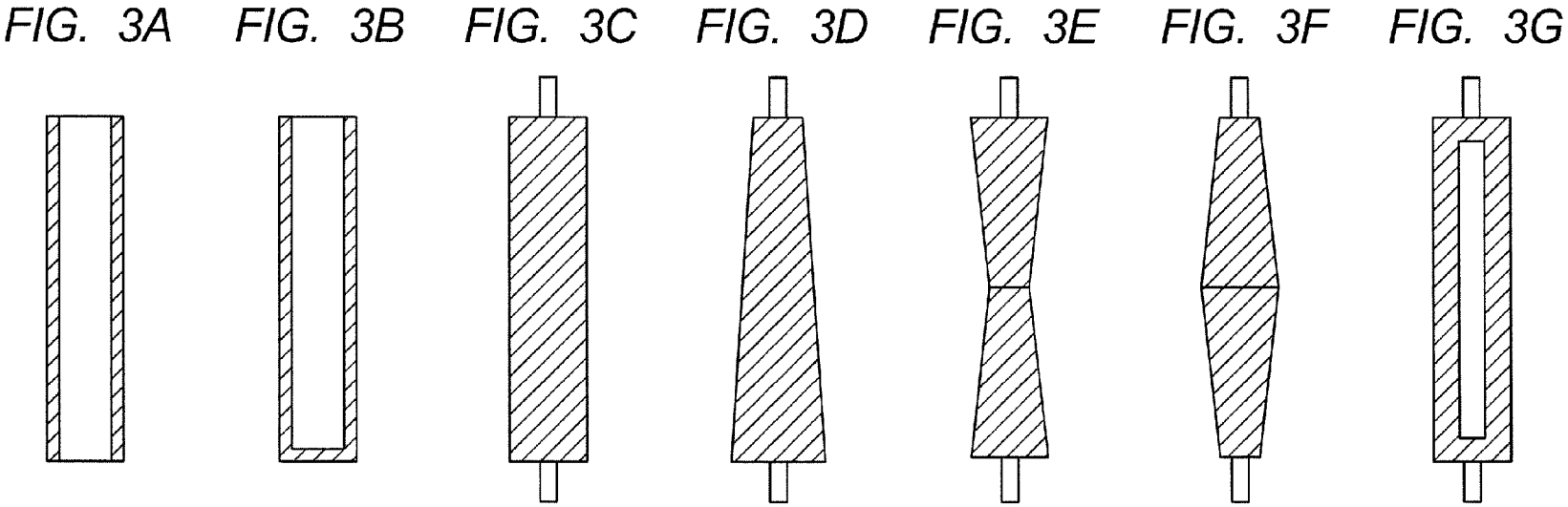
FIGS. 3A, 3B, 3C, 3D, 3E, 3F and 3G are schematic views for illustrating one example of the method for forming a coating film according to the present invention.

The cylinder shape here includes a belt-like shape and a tube-like shape having an opening at least at one of both ends, having an inner peripheral surface and having a straight shape in which the size of a circle of a cross section perpendicular to the axis direction is constant, as illustrated in FIGS. 3A and 3B. The column shape includes a roller-like shape having no opening at both ends and having a straight shape in which the size of a circle of a cross section perpendicular to the axis direction is constant, as illustrated in FIG. 3C. Furthermore, the cylinder shape or the column shape also includes a crown shape, an inverted crown shape and a circular truncated cone shape, in which the size of a circle of a cross section perpendicular to the axis direction is different, as illustrated in FIGS. 3D, 3E, and 3F. The cylinder shape or the column shape also includes a hollow column shape as illustrated in FIG. 3G.

The material of the substrate is selected depending on the application, and may be a single material of a metal, ceramics, plastic, rubber or resin, may be a laminate, or may be a composite.

When the substrate has a cylinder shape and has no rigidity, the substrate can be externally fitted and held on a core having an outer diameter corresponding to the inner diameter of the substrate in formation of a coating film on the outer peripheral surface.

When the substrate has a cylinder shape like a mandrel or has a cylinder shape and has rigidity, the substrate is longitudinally held to be rotatably driven or moved up and down without being externally fitted on the core.

A coating film can also be formed on not only the outer peripheral surface of the cylindrical substrate but also the inner peripheral surface thereof, according to the present invention.

(3) Nozzle

The nozzle may be a nozzle that can stably quantitatively supply the coating liquid (first liquid) in order to form a coating film having a uniform thickness.

The nozzle may be a nozzle in which application can be made while a bead is formed, for example, a nozzle in which a tube is mounted to a coating liquid-supplying unit (not illustrated) such as a tube dispenser to supply a liquid, and a nozzle in which a liquid is quantitatively supplied from a slit.

Figure 4A:
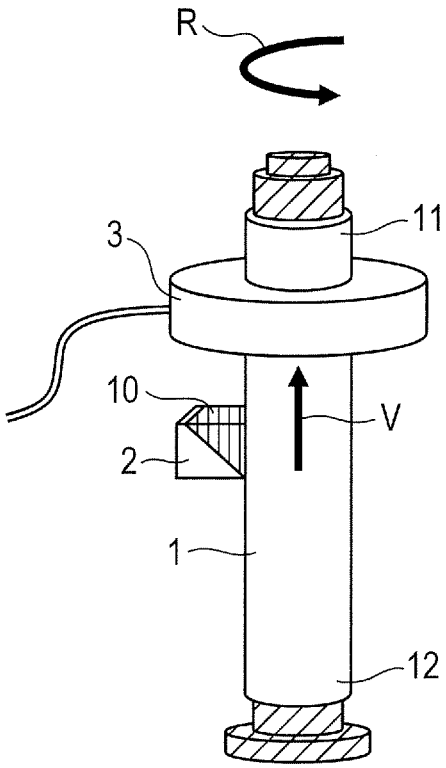
FIGS. 4A and 4B are illustration views of another aspect of the method for forming a coating film according to the present invention.

Examples include a system in which a liquid is quantitatively supplied from a nozzle having a ring-like slit that is formed so as to surround the substrate over substantially all of the peripheral surface, as illustrated in FIG. 4A. The width of the inner diameter of the tube or the slit can be about 1 to 3 mm in order to stably quantitatively supply a liquid.

The material of the tube may be a material that is neither eroded nor corroded by the coating liquid, such as a fluororesin or a metal. Also in the case of the ring-like slit, the material may be a material that is not corroded and is hardly deformed by a metal or the like.

The gap between the substrate 1 and the nozzle 3 can be a gap so that a bead can be formed between the liquid film of the second liquid formed in advance and the first liquid supplied from the nozzle 3, and can be about 0 to 10 mm.

(4) Impregnation Material

As the impregnation material, a sponge that has a hole, is not corroded by the coating liquid (second liquid), and can sufficiently include the coating liquid can be used. The material is preferably a sponge of urethane or the like, and further preferably a roll-like sponge to thereby enable to feed a new surface every one rotation of the impregnation material in a liquid film formation process, and to suppress an influence on the change of the abutment surface with the substrate over time due to friction with the sponge. As the impregnation material, a brush, non-woven fabric, gauze or the like can be used instead of a sponge as long as such a material can be sufficiently impregnated with the second liquid to be used for pressing and application.

Figure 4B:
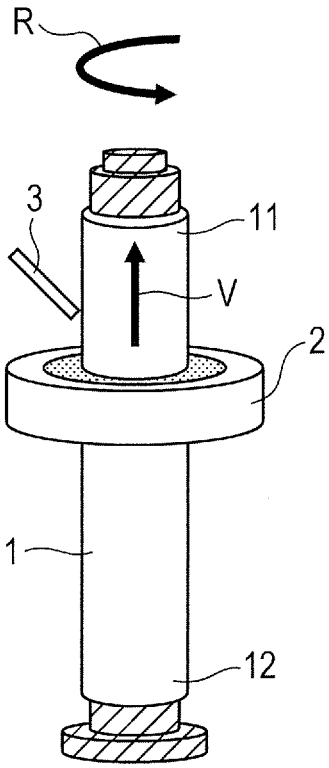

As illustrated in FIG. 4B, the impregnation material may be a substantial ring-like sponge that is formed so as to surround the substrate over the peripheral surface, and the sponge may be used for pressing and application.

When a highly volatile organic solvent or the like is used as the second liquid, a period from the application step to the drying of the second liquid is short and thus the relative distance between the upper end of the impregnation material and the discharge port of the nozzle in the axis direction can be 20 mm or less so that the first liquid can be applied before the drying. When the nozzle 3 and the impregnation material 2 are disposed at the same position in the circumferential direction of the substrate 1, as illustrated in FIGS. 1A to 1D, the distance between the nozzle 3 and the upper end of the impregnation material 2 can be 5 mm or more in order to stably form the bead 13 of the first liquid, as described above.

(5) Affinity of First Liquid with Second Liquid

In the present invention, in order that the bead is formed by the first liquid and applied to the liquid film of the second liquid to form a coating film in which the first liquid is compatible with the second liquid, the second liquid is required to be a liquid having a high affinity with the first liquid. The solubility parameter can be used as a measure of affinity of a liquid (see Hideki Yamamoto "SP value (solubility parameter) fundamentals and application" seminar text, P 31-38, 2006).

The difference in solubility parameter between two liquids exhibits energy required for dissolution. As the difference between the solubility parameter of the first liquid and the solubility parameter of the second liquid is smaller, the first liquid is easily compatible with the second liquid, and has a high affinity with the second liquid. When the difference between the solubility parameter of the first liquid and the solubility parameter of the second liquid is 6.0 or less, the first liquid is sufficiently compatible with the second liquid, and can more stably form a bead.

In the regular solution theory, $(\Delta E^V/V)^{0.5}$ has been defined as the parameter of intermolecular force, namely, dissolving power in a solution as in Expression (1) by Hildebrand:

$$\delta=(\Delta E^V/V)^{0.5} \quad (1)$$

wherein δ represents the solubility parameter, $\Delta E^V$ represents the molar evaporation energy [kcal/mol], and V represents the molar molecular volume [$cm^3$/mol].

$\Delta E^V$ can also be determined by the following Expression (2).

$$\Delta E^V=23.7T_b+0.02T_b^2-2950 \quad (2),$$

wherein Tb represents the boiling point.

When the solvent is a mixture, the solubility parameter (δmix) of a mixed solvent can be determined by the following Expression (3).

$$\delta mix=(\phi_1\delta_1+\phi_2\delta_2+\ldots+\phi_n\delta_n) \quad (3),$$

wherein $\phi_n$ represents the volume fraction of the $n^{th}$ component, and $\delta_n$ represents the solubility parameter of the $n^{th}$ component.

(Schematic Configuration of Electrophotographic Fixing Member)

The present invention is effective for a fixing member for use in a fixing process in an electrophotographic apparatus such as a copier or a printer. In the fixing process, a predetermined fixing nip portion N for heating and pressurizing is formed between a pressurizing member and a fixing belt. A recording material on which an image is formed by an unfixed toner T, serving as an object to be heated, is sandwiched by the fixing nip portion N and conveyed. A toner image is thus heated and pressurized. As a result, the toner image is subjected to melting, color mixing and then cooling to thereby be fixed on the recording material. The toner heated and molten can be more uniformly pressurized by the fixing member in the fixing process to thereby form an image with no unevenness in gloss.

While the fixing member is configured from the substrate, the primer layer, the cured silicone rubber layer, the fluororesin layer and the like, each layer can have desired film thickness and hardness.

The method for forming a coating film of the present invention is particularly effective for forming a primer layer in a method for producing a fixing member.

That is, according to the present invention, a method for producing a fixing member having a cylindrical or columnar substrate and a cured silicone rubber layer on the substrate includes (1) a step of forming a primer layer on the peripheral surface of the substrate, (2) a step of forming a layer of an addition curing type silicone rubber composition on the surface of the primer layer, and (3) a step of curing the layer of the addition curing type silicone rubber composition to form the cured silicone rubber layer, and optionally (4) a step of forming a release layer on the surface of the cured silicone rubber layer.

Then, the step (1) includes (i) a coating film formation step of a first liquid, including supplying a first liquid from a nozzle, while allowing the substrate to relatively rotate against the nozzle and also allowing the nozzle and the substrate to relatively move in the direction along with the rotation axis of the substrate, to thereby form a coating film of the first liquid, and (ii) before supplying the first liquid from the nozzle in the step (i), a liquid film formation step of a second liquid, including pressing a member impregnated with a second liquid on the peripheral surface of the substrate, to form a liquid film of the second liquid on the peripheral surface of the substrate.

Furthermore, the step (i) includes supplying the first liquid from the nozzle onto the liquid film of the second liquid formed on the peripheral surface of the substrate before drying the liquid film of the second liquid, to form a bead of the first liquid between the nozzle and the liquid film of the second liquid, and applying and extending the bead in the circumferential direction of the substrate, wherein the second liquid is the same as the first liquid or a liquid having a difference in solubility parameter from the first liquid of 6.0 or less, and any one or both of the first liquid and the second liquid include a raw material of the primer.

Figure 5:
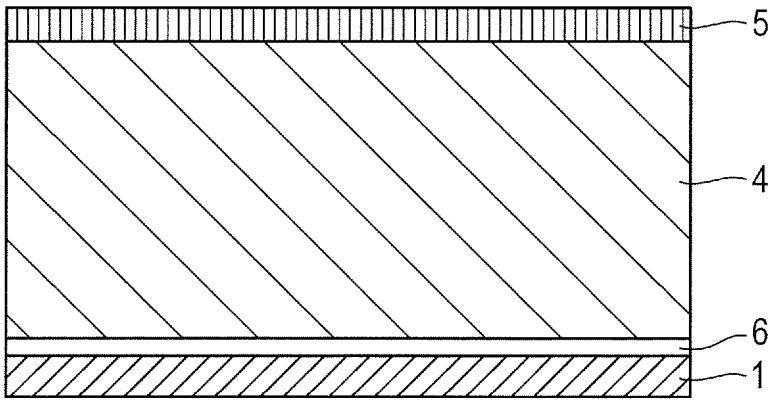
FIG. 5 is a cross-sectional view of a fixing belt according to the present invention.

FIG. 5 is a schematic transverse cross sectional view illustrating a layer configuration of a fixing belt in the present invention.

A primer layer 6, a cured silicone rubber layer 4 and a release layer 5 are formed on the cylindrical substrate 1. The primer layer 6 allows the substrate 1 and the cured silicone rubber layer 4 to adhere to each other.

(1) Substrate

As the material of the substrate for use in the fixing member, for example, a metal or an alloy, such as aluminum, iron, stainless steel or nickel, or a heat-resistant resin such as polyamideimide is used. When the fixing member has a columnar shape, a mandrel is used for the substrate 1. Examples of the material of the mandrel include a metal and an alloy, such as aluminum, iron and stainless steel.

When the fixing member has a cylindrical shape, examples of the substrate 1 include an electroforming nickel belt, and a heat-resistant resin belt made of polyimide or the like.

In order to suppress paper conveyability and the occurrence of paper wrinkles in the fixing member, the outer diameter shape of the substrate can be a crown shape or an inverted crown shape.

(2) Primer Layer

The primer layer is a layer for allowing the substrate and the cured silicone rubber layer to adhere to each other by the method for forming a coating film of the present invention.

(2-1) Basic Configuration of Primer Layer

The raw material for forming the primer layer includes a mixture including (A) a silane coupling agent, (B) a catalyst, (C) a solvent and (D) an additive. For the purpose of further more enhancing the adhesiveness of the primer layer to the cured silicone rubber layer, (E) an active hydrogen group-containing polysiloxane may be further added.

(A) Silane Coupling Agent

The silane coupling agent includes an agent having at least one of a hydrolyzable functional group and a reactive organic functional group. The hydrolyzable functional group includes a methoxy group, an ethoxy group and a propoxy group, and reacts with a filler of a metal or rubber for binding. The reactive organic functional group includes a vinyl group, an allyl group and an epoxy group, and reacts with a silicone rubber for binding.

Specific examples of the silane coupling agent include γ-glycidoxypropyltrimethoxysilane, methacryloxypropyltrimethoxysilane and allyltrimethoxysilane.

(B) Catalyst

The catalyst includes a platinum type compound, and serves to promote the addition reaction between the silicone rubber layer and the primer layer, resulting in an enhancement in adhesiveness. Specific examples of the platinum type compound include a complex compound of chloroplatinic acid and divinyltetramethyldisiloxane, and a carbonylcyclovinylmethylsiloxane complex compound.

(C) Solvent

The solvent includes an organic solvent, and can be a solvent that is easily volatilized and has a high wettability to the substrate. Specifically, the solvent includes n-heptane, n-hexane, toluene and ethyl acetate, with respect to the above-mentioned material of the substrate.

(D) Additive

The additive is added for the purpose of visualizing the coating film of the primer and visually observing the surface of the coating film. Specifically, the additive includes a pigment such as iron oxide.

(E) Active Hydrogen Group-Containing Polysiloxane

The active hydrogen group-containing polysiloxane may be added for the purposes of the reaction with an unsaturated aliphatic group such as a vinyl group included in the cured silicone rubber layer 4 and the enhancement in adhesiveness. Specifically, the polysiloxane includes linear, branched and cyclic polysiloxanes. The polysiloxane includes methyl hydrogen polysiloxane and dimethyl-methyl hydrogen polysiloxane.

(2-2) Method for Forming Primer Layer

The method for forming a coating film according to the present invention can be used to thereby form a coating film of the primer layer having a uniform thickness. Herein, both of the first liquid and the second liquid may include the raw material of the primer layer, or any one of the first liquid and the second liquid may include the raw material of the primer layer.

When both of the first liquid and the second liquid include the raw material of the primer layer, such liquids may be the same or different with respect to the compositions thereof.

When the first liquid and the second liquid are different, however, such liquids are required to have a high affinity with each other.

When both of the first liquid and the second liquid include the raw material of the primer layer, examples of a specific combination include the following.

First Liquid:

Mixture including (A) silane coupling agent, (B) catalyst, (C) solvent, (D) additive and (E) active hydrogen group-containing polysiloxane;

Second Liquid:

Mixture including (A) silane coupling agent, (B) catalyst, (C) solvent and (D) additive above.

When any one of the first liquid and the second liquid include the raw material of the primer layer, the same solvent as the solvent included in one liquid including the raw material of the primer can be used as the other liquid not including the raw material of the primer. For example, when the first liquid is one liquid including the raw material of the primer layer and includes n-heptane as the solvent, n-heptane can be used as the second liquid. On the contrary, when the second liquid is one liquid including the raw material of the primer layer and includes n-heptane as the solvent, n-heptane can be used as the first liquid.

Thus, a primer layer having a uniform thickness can be formed on the peripheral surface of the substrate.

Any one or both of the first liquid and the second liquid may also be a solution in which a silane coupling agent or a platinum type compound is dissolved in an organic solvent.

After the first liquid is applied on the liquid film of the second liquid, the resultant is heated in order to react the substrate with the silane coupling agent in the primer, thereby allowing the primer layer to tightly adhere to the surface of the substrate.

(3) Cured Silicone Rubber Layer and Formation Method Thereof

The cured silicone rubber layer 4 functions as a layer that allows the fixing member to carry elasticity so that a toner is not collapsed by pressing in fixing. In order to exhibit such a function, the cured silicone rubber layer 4 can be a cure product of the addition curing type silicone rubber composition. The reason for this is because the degree of crosslinking of the addition curing type silicone rubber composition can be adjusted depending on the type of a filler and the amount thereof added to thereby adjust the elasticity of the cured silicone rubber layer 4.

The addition curing type silicone rubber composition is obtained by blending and dispersing an additive such as a filler with and in a liquid base of the addition curing type silicone rubber. The addition curing type silicone rubber is applied onto the primer layer formed on the surface of the substrate and heated to thereby promote the curing of the silicone rubber itself and at the same time the crosslinking reaction along with hydrosilylation between the silicone rubber and the primer, allowing the substrate and the cured silicone rubber layer to adhere to each other.

(4) Release Layer and Formation Method Thereof

As the release layer 5, a fluororesin, for example, resins listed below are mainly used: tetrafluoroethylene-perfluoro (alkyl vinyl ether) copolymer (PFA), polytetrafluoroethylene (PTFE), tetrafluoroethylene-hexafluoropropylene copolymer (FEP) and the like.

Among the materials listed above, PFA can be adopted from the viewpoints of moldability and toner releasability.

A forming method is not particularly limited, but a method in which a tube formed by the addition curing type silicone rubber adhesive is covered with and adheres to the cured silicone rubber layer, and a method in which the surface of the cured silicone rubber layer is directly coated with a fluororesin fine particle or is coated with the particle dispersed in a solvent to be formed into a coating material, and then dried and molten for film formation are known.

According to the present invention, a coating film whose coating film unevenness is reduced and which is uniform as compared with a conventional film can be formed by a method in which a coating film is formed on the peripheral surface of a substrate while a nozzle and the substrate are allowed to relatively move in the axis direction against the substrate that relatively rotates against the nozzle.

EXAMPLES

Hereinafter, the method for forming a coating film of the present invention is described with reference to the fixing member as an example.

In Table 1, an apparatus for a method for forming a coating film in FIGS. 1A to 1D is designated as α, an apparatus for a method for forming a coating film in FIG. 4A is designated as β, and an apparatus for a method for forming a coating film in FIG. 4B is designated as γ.

Example 1

<1. Formation and Evaluation of Primer Layer>

In the above-described method for forming a coating film in FIGS. 1A to 1D, a cylinder made of nickel, having an inner diameter of 30 mm, a thickness of 40 μm and a length of 400 mm was used as the substrate. The cylinder itself had no rigidity, and thus was inserted to a core and held.

As the first liquid and the second liquid, diluted liquid of a silicone dispersion (trade name: DY39-051A, and DY39-051B; Dow Corning Toray Co., Ltd.) was used. That is, "DY39-051A" and "DY39-051B" were mixed with mass ratio of 1:1. Then, by diluting the mixture of "DY39-051A" and "DY39-051B" with heptanes to a five-fold amount by mass, the first and the second liquids were prepared.

The first and the second liquids thus obtained contains:

tetraethoxysilane which corresponds to the component (A), a platinum catalyst which corresponds to the component (B), heptane, ethylacetate, toluene and isopropylalcohol which correspond to the component (C), iron oxide which corresponds to the component (D), and active hydrogen group-containing polysiloxane which corresponds to the component (E).

The solubility parameter δ of each of the first liquid and the second liquid having the above composition was 8.0.

With respect to conditions of the coating film apparatus, a fluororesin tube mounted to a tube dispenser (trade name: MT-410, manufactured by Musashi Engineering, Inc.), having an outer diameter of 3 mm and an inner diameter of 2 mm, was used as the nozzle 3. The nozzle was arranged so that the distance "d" between the discharge port and the surface of the liquid film of the second liquid on the substrate was 1 mm.

As the impregnation material 2, a sponge having a length L of 14 mm (trade name: SF Felt, produced by Bridgestone Diversified Chemical Products Co., Ltd.) was used.

The nozzle and the impregnation material were disposed at the same position in the circumferential direction of the substrate, and the distance "p" between the nozzle and the upper end of the impregnation material was set to 8 mm.

First, while the substrate 1 was left to still stand, the second liquid was supplied from a second liquid-supplying nozzle (not illustrated) to the impregnation material at 42 ml/min, and the impregnation material was impregnated with the second liquid. Then, the substrate was allowed to move at a movement velocity V of 960 mm/min and also rotate at a rotation speed R of 215 rpm. In addition, the first liquid was supplied onto the liquid film of the second liquid at a supply speed of 42 ml/min. Then, while a bead was formed on the nozzle and the liquid film of the second liquid, the bead was applied and extended on the liquid film of the second liquid to form coating films of the second liquid and the first liquid on the substrate.

The substrate on which such coating films were formed was placed in an oven heated at a temperature of 165° C., and heated for 4 minutes to bake the coating films, forming a primer layer.

Herein, the solubility parameter of the first liquid is designated as δ1, the solubility parameter of the second liquid is designated as δ2, and the difference between the two solubility parameters is designated as $|\delta 1-\delta 2|$.

The resulting primer layer was visually observed, and evaluated based on the following criteria. The results are shown in Table 1.

<Evaluation Criteria>

Rank A: unevenness was hardly observed.

Rank B: spiral application unevenness was observed.

<2. Production of Fixing Member>

Subsequently, in order to form a cured silicone rubber layer on the primer layer, an addition curing type silicone rubber (trade name: SE4430; produced by Dow Corning Toray Co., Ltd.) was applied onto the primer layer by a ring coating method. Thereafter, the substrate was heated in an electric furnace set at 200° C. for 4 hours to cure the addition curing type silicone rubber, providing a cured silicone rubber layer.

After cooling to room temperature, an addition curing type silicone rubber adhesive (trade name: SE1819CV; produced by Dow Corning Toray Co., Ltd.) was applied on the surface of the cured silicone rubber layer so that the thickness was about 20 μm.

Then, a fluororesin tube having an inner diameter of 29 mm and a thickness of 30 μm (trade name: KURANFLON-LT; produced by Kurabo Industries Ltd.) was laminated on the cured silicone rubber layer.

Then, the resulting laminate was heated in an electric furnace set at 200° C. for 1 hour to cure the adhesive, securing the fluororesin tube on the cured silicone rubber layer, and thereafter both end portions were cut to provide a fixing belt having a width of 343 mm.

The fixing belt was mounted to a color copier (trade name: IR-ADVANCE C5051, manufactured by Canon Inc.) to form an electrophotographic image. The unevenness in gloss of the resulting electrophotographic image was evaluated. The unevenness in gloss of the electrophotographic image was caused by the unevenness in hardness of the fixing belt due to coating film unevenness of the primer. That is, coating film unevenness of the primer can be an index indicating the magnitude of an influence on the quality of the electrophotographic image.

An electrophotographic image for evaluation was formed by applying a cyan toner and a magenta toner onto substantially all of the surface of A4-size (smooth surface) coat paper (trade name: Image Coat Gloss 128; manufactured by Canon Inc.) in a density of 100%. The unevenness in gloss of the image for evaluation was visually observed, and evaluated according to the following criteria. The results are shown in Table 1.

<Evaluation Criteria>

Rank A: extremely high-quality electrophotographic image in which unevenness in gloss was hardly observed.

Rank B: electrophotographic image in which unevenness in gloss was very remarkable.

Examples 2 to 4 and Comparative Examples 1 to 2

Formation of each primer layer and production of each fixing belt were performed in the same manner as in Example 1 by using the first and second liquids as shown in Table 1. The evaluation result of each primer layer and the evaluation result of each fixing belt obtained are also shown in Table 1.

Example 5

The apparatus for forming a coating film illustrated in FIG. 4B was used. That is, a sponge having a doughnut shape surrounding the substrate over the peripheral surface and having a length L of 14 mm (SF Felt; produced by Bridgestone Diversified Chemical Products Co., Ltd.) was used as the impregnation material 2.

Formation of a primer layer and production of a fixing belt were performed in the same manner as in Example 1, except that heptane was used as the first liquid, and "primer raw material-containing coating material 1" in Example 1 was used as the second liquid. The evaluation result of the primer layer and the evaluation result of the fixing belt obtained are also shown in Table 1.

Comparative Example 3

Formation of a primer layer and production of a fixing belt were performed in the same manner as in Example 5, except that "primer raw material-containing coating material 1" in Example 1 was used as the first liquid and, on the other hand, no second liquid was used. The evaluation result of the primer layer and the evaluation result of the fixing belt obtained are also shown in Table 1.

Example 6

The apparatus for forming a coating film illustrated in FIG. 4A was used. That is, a ring head having a doughnut shape surrounding the substrate over the peripheral surface and having a slit having a width of 3 mm on the inner peripheral surface was used as the nozzle.

Formation of a primer layer and production of a fixing belt were performed in the same manner as in Example 1, except that ethanol was used as the first liquid and "primer raw material-containing coating material 1" in Example 1 was used as the second liquid. The evaluation result of the primer layer and the evaluation result of the fixing belt obtained are also shown in Table 1.

Comparative Example 4

Formation of a primer layer and production of a fixing belt were performed in the same manner as in Example 6, except that no first liquid was used. The evaluation result of the primer layer and the evaluation result of the fixing belt obtained are also shown in Table 1.

TABLE 1

| | | Apparatus | First liquid | δ1 | Second liquid | δ2 | \|δ1 − δ2\| | Outer appearance evaluation of prime layer | Image evaluation |
|---|---|---|---|---|---|---|---|---|---|
| Example | 1 | α | Primer raw material-containing coating material 1 | 8.0 | Primer raw material-containing coating material | 8.0 | 0.0 | A | A |
| | 2 | α | Id. | 8.0 | Heptane | 7.4 | 0.6 | A | A |
| | 3 | α | Id. | 8.0 | Ethanol | 13.0 | 5.0 | A | A |
| | 4 | α | Id. | 8.0 | Solution of chloroplatinic acid in toluene | 8.9 | 0.9 | A | A |
| | 5 | γ | Heptane. | 7.4 | Primer raw material-containing coating material 1 | 8.0 | 0.6 | A | A |
| | 6 | β | Ethanol | 13.0 | Primer raw material-containing coating material 1 | 8.0 | 5.0 | A | A |

TABLE 1-continued

| | | Apparatus | First liquid | δ1 | Second liquid | δ2 | \|δ1 − δ2\| | Outer appearance evaluation of prime layer | Image evaluation |
|---|---|---|---|---|---|---|---|---|---|
| Comparative Example | 1 | α | Primer raw material-containing coating material 1 | 8.0 | Ethylene glycol | 16.0 | 8.0 | B | B |
| | 2 | α | Primer raw material-containing coating material 1 | 8.0 | Water | 23.4 | 15.4 | B | B |
| | 3 | γ | Primer raw material-containing coating material 1 | 8.0 | None | — | — | B | B |
| | 4 | β | None | — | Primer raw material-containing coating material 1 | 8.0 | — | B | B |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-223459, filed Oct. 28, 2013, which is hereby incorporated by reference herein in its entirety.

What is claimed is:

1. A method for forming a coating film on a peripheral surface of a cylindrical or columnar substrate, comprising:

a first liquid coating film forming step comprising:

supplying a first liquid from a nozzle to the peripheral surface of the substrate that relatively rotates against the nozzle, while relatively moving the nozzle and the substrate in an axial direction of the substrate, and forming a first liquid coating film on the peripheral surface of the substrate; and a step of forming a liquid film of a second liquid on the peripheral surface of the substrate, prior to supplying the first liquid to the peripheral surface of the substrate, by pressing a member comprising the second liquid, on the peripheral surface of the substrate, while relatively rotating the member and the substrate, and relatively moving the member and the substrate in an axial direction of the substrate, and forming a liquid film of the second liquid on the peripheral surface of the substrate, the second liquid being the same as the first liquid or having a difference in solubility parameter from the first liquid of 6.0 or less, wherein, in the first liquid coating film forming step, the first liquid is supplied onto the liquid film of the second liquid before drying the liquid film of the second liquid, and wherein the first liquid coating film forming step further comprises the steps of:

forming a bead of the first liquid between the nozzle and the liquid film of the second liquid, and extending the bead in a circumferential direction of the substrate.

2. The method for forming a coating film according to claim 1, wherein R, V and L satisfy a relationship of expression (1):

$$L-(V/R)\geq 0 \text{ (mm)} \quad (1),$$

wherein: R (rpm) represents a rotation speed of the substrate,

V (mm/min) represents a movement velocity of the substrate to the nozzle in an axial direction, and L (mm) represents a length of the member comprising the second liquid in an axial direction of the substrate.

3. The method for forming a coating film according to claim 2, wherein L−(V/R) is 10 (mm) or less.

4. The method for forming a coating film according to claim 1, wherein the first liquid has a solubility parameter of 7.4 to 13.0.

5. A method for producing a fixing member having a cylindrical or columnar substrate and a cured silicone rubber layer on the substrate, comprising:

(1) forming a primer layer on a peripheral surface of the substrate, (2) forming a layer of an addition curing type silicone rubber composition on a surface of the primer layer, and (3) curing the layer of the addition curing type silicone rubber composition to form the cured silicone rubber layer, wherein the step (1) comprises the steps of:

(i) forming a coating film of a first liquid by applying the first liquid from a nozzle to a peripheral surface of the substrate, while relatively rotating the substrate against the nozzle and also relatively moving the nozzle and the substrate in a direction along with a rotational axis of the substrate, and (ii) forming a liquid film of a second liquid on the peripheral surface of the substrate, prior to forming the coating film of the first liquid, by pressing a member impregnated with the second liquid on the peripheral surface of the substrate, wherein, in the step (i), the first liquid is supplied onto the liquid film of the second liquid on the peripheral surface of the substrate before drying the liquid film of the second liquid, wherein the step (i) further comprises the steps of:

forming a bead of the first liquid between the nozzle and the liquid film of the second liquid, and extending the bead in a circumferential direction of the substrate, wherein the second liquid is the same as the first liquid or is a liquid having a difference in solubility parameter from the first liquid of 6.0 or less, and wherein any one or both of the first liquid and the second liquid comprise a raw material of the primer layer.

6. The method for producing a fixing member according to claim 5, wherein any one or both of the first liquid and the second liquid comprise a silane coupling agent and an active hydrogen group-containing polysiloxane as a raw material of the primer layer.

7. The method for producing a fixing member according to claim 6, wherein among the first liquid and the second liquid, a liquid comprising no raw material of the primer layer comprises any solvent selected from the group consisting of heptane, ethanol, and toluene.

8. The method for producing a fixing member according to claim 5, wherein the first liquid has a solubility parameter of 7.4 to 13.0.

* * * * *